US005295335A

United States Patent [19]

Collier

[11] Patent Number: 5,295,335

[45] Date of Patent: Mar. 22, 1994

[54] PREFRABRICATED SHELTER

[76] Inventor: Leroy H. Collier, 716 Gay St., Portsmouth, Ohio 45662

[21] Appl. No.: 952,597

[22] Filed: Sep. 28, 1992

[51] Int. Cl.[5] ..... E04B 1/32

[52] U.S. Cl. ..... 52/86; 52/292; 52/293.3; 135/101

[58] Field of Search ..... 52/86, 169.9, 292, 293.3; 135/101, 114, 116, 101

[56] References Cited

U.S. PATENT DOCUMENTS

| | | | |
|---|---|---|---|
| 3,114,377 | 12/1963 | Clement | 135/116 |
| 3,277,621 | 10/1966 | Merdich | 52/86 |
| 3,441,037 | 4/1969 | Transeau | 135/116 |
| 3,974,602 | 8/1976 | Pohl et al. | 52/143 |
| 4,649,676 | 3/1987 | Davey | 52/86 |
| 4,769,962 | 9/1988 | Pohl et al. | 135/101 |
| 4,885,879 | 12/1989 | Plantier | 52/86 |

FOREIGN PATENT DOCUMENTS

| | | | |
|---|---|---|---|
| 2051171 | 1/1981 | United Kingdom | 52/86 |

*Primary Examiner*—Carl D. Friedman
*Assistant Examiner*—Christopher T. Kent
*Attorney, Agent, or Firm*—Michael I. Kroll

[57] ABSTRACT

A prefabricated shelter is provided which consists of an arched framework having open opposite ends, a structure for securing the framework to the ground and a roof assembly mounted to the top of the arched framework, so as to protect and cover anything positioned under the roof assembly.

8 Claims, 2 Drawing Sheets

PREFRABRICATED SHELTER

BACKGROUND OF THE INVENTION

1. Field of the Invention

The instant invention relates generally to protective enclosures and more specifically it relates to a prefabricated shelter.

2. Description of the Prior Art

Numerous protective enclosures have been provided in prior art. For example, U.S. Pat. No. 2,801,716 to Colby, Jr., U.S. Pat. No. 2,827,138 to Roy, Jr.; U.S. Pat. No. 2,988,810 to Wilken; U.S. Pat. No. 3,277,621 to Merdich; U.S. Pat. No. 3,464,168 to Russell et al.; U.S. Pat. No. 3,828,492 to Schliemann et al.; U.S. Pat. No. 3,974,602 to Pohl et al.; U.S. Pat. No. 4,023,838 to Sabec; U.S. Pat. No. 4,068,423 to Marsh; U.S. Pat. No. 4,091,584 to Brown; U.S. Pat. No. 4,347,690 to Wallace Jr.; U.S. Pat. No. 4,961,297 to Bernard and U.S. Pat. No. 4,970,833 to Porter all are illustrative of such prior art.

U.S. Pat. No. 2,801,716: This patent has a rounded arch while the instant invention is different in design. The method of fastening the arches to the base is entirely different. The arches are also made out of different materials. The base rails and anchoring systems are entirely different. There is no similarity.

U.S. Pat. No. 2,827,138: This patent has a rounded arch and bears no similarity in design or materials to the instant invention. The complicated system of pulleys, springs and anchoring systems are totally different.

U.S. Pat. No. 2,988,810: This patent contains a system for concaving roofing materials, so that the roofing material itself becomes the framing. It has no detail of or similarity to the instant invention.

U.S. Pat. No. 3,277,621: This carport bears no resemblance to the instant invention either in materials or design. The arches are totally different in design and are constructed of different materials. The anchoring systems are totally different. This design has a guiding system, which the instant invention does not have. The roofing materials are different and the sides and end enclosures are also different.

U.S. Pat. No. 3,464,168: This shelter is designed to be connected in sections and is different from the instant invention. The arches are rounded with the arch design and construction totally different. Anchoring of the arches is complicated, while end design and construction is different. The door and vest is not used in the instant invention and there is no nuts or bolts.

U.S. Pat. No. 3,828,492: This rounded arch structure bears no resemblance in design, materials or structure to the instant invention. The vault like design in sheeting is different as well as the design and materials of the ribs. The base design is also different.

U.S. Pat. No. 3,974,602: This unit is a garage with ends and doors. The framing is of flat materials with many cuts, fastened with screws or at angles that may be welded. The instant invention does not contain any of this. The base as well as the method of fastening the ribs to the base is different. The unit has support posts, while the instant invention does not need them. Roofing materials and design are different.

U.S. Pat. No. 4,023,838: This is a protective cover for a work vehicle, while uses rib construction and an unique frame configuration. It bears no resemblance in design, materials or usage to the instant invention. This is a protective cover over a work vehicle to protect the operator.

U.S. Pat. No. 4,068,423: This unit is a greenhouse with a wood base, plastic pipes, totally enclosed with a door and bears no resemblance to the instant invention in materials or design.

U.S. Pat. No. 4,091,584: This is a skeletal building frame made of lightweight polyvinyl tubing and bears no resemblance to the instant invention in materials or design. The base, the tubing, the supports, and the sheathing applications are different.

U.S. Pat. No. 4,347,690: This complicated system of pipe, plates, fasteners, nuts, bolts, braces and rectangular tubular construction bears no resemblance to the easy construction of the instant invention. Securing of the base and the leg design of the arch is totally different.

U.S. Pat. No. 4,961,297: This is an enclosed building with arches reinforced with welded braces. It is totally different from the one piece arch of the instant invention. Peak fasteners and rounded edges are complicated items of unique bends, fasteners, nuts and bolts; none of which the instant invention has. The covering materials are also different.

U.S. Pat. No. 4,970,833: This square tubular frame is cut, welded and bolted together in parts. It has no resemblance in material or design to the instant invention. It method of fastening to a base is entirely different. Application of roofing material is also different.

While these units ma be suitable for the particular purpose to which they address, they would not be as suitable for the purposes of the present invention as heretofore described.

SUMMARY OF THE INVENTION

The instant invention is a prefabricated shelter that contains an arched framework having open opposite ends. A structure secures the framework to the ground. A roof assembly is mounted to the top of the arched framework, to protect and cover anything positioned under the roof assembly.

A primary object of the present invention is to provide a prefabricated shelter that will overcome the shortcomings of the prior art devices.

Another object is to provide a prefabricated shelter in which its framework includes a plurality of spaced apart single unit arched ribs to support a roof of corrugated sheathing making the shelter generally lightweight and strong.

An additional object is to provide a prefabricated shelter that can be made in multiple sizes, so that it can be used in different ways for protecting and covering various objects and people.

A further object is to provide a prefabricated shelter that is simple and easy to use.

A still further object is to provide a prefabricated shelter that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
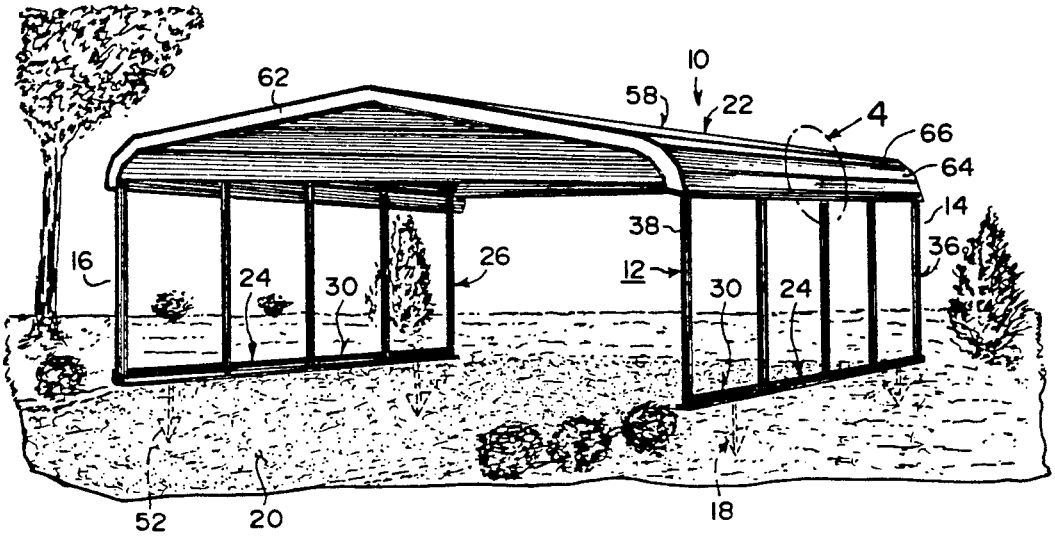
FIG. 1 is a perspective view of the instant invention secured to the ground.
Figure 2:
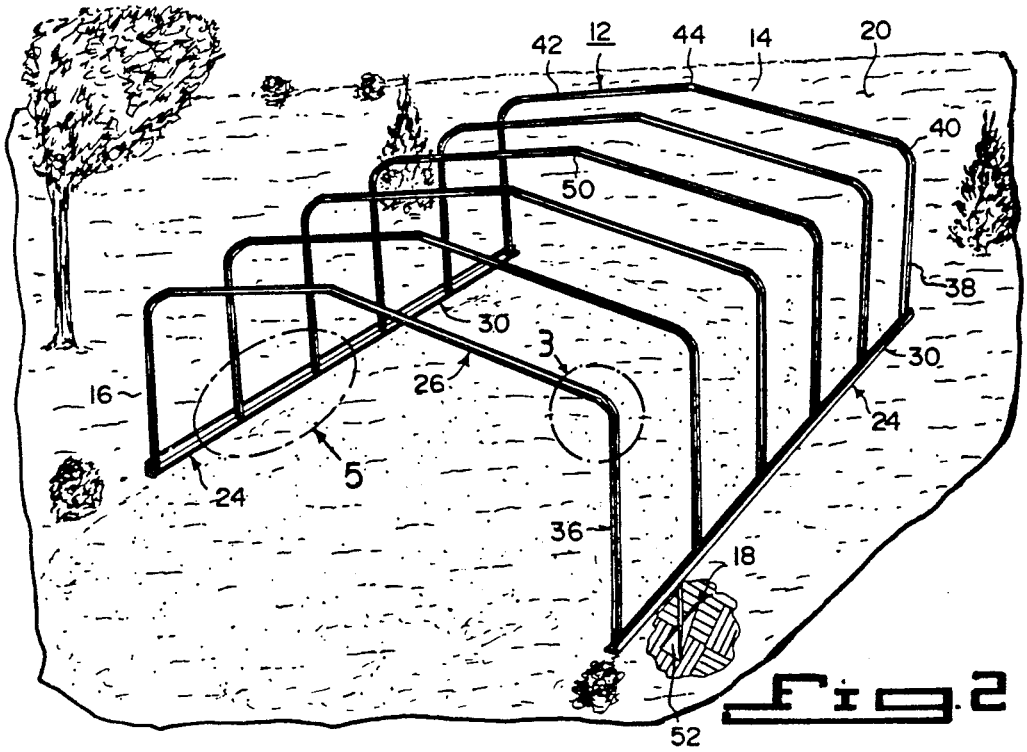
FIG. 2 is a perspective view of the framework of the instant invention with the roof assembly removed therefrom.
Figure 3:
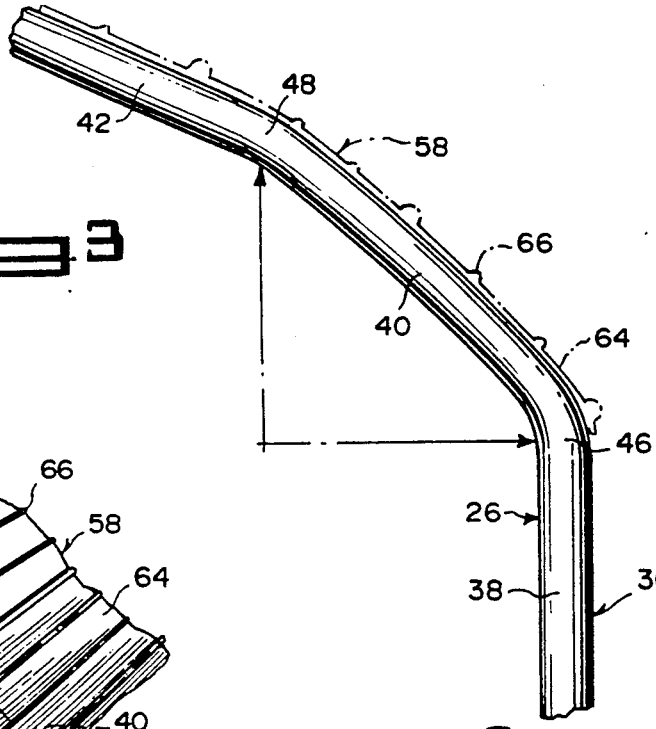
FIG. 3 is an enlarged elevational view as indicated by arrow 3 in FIG. 2.
Figure 4:
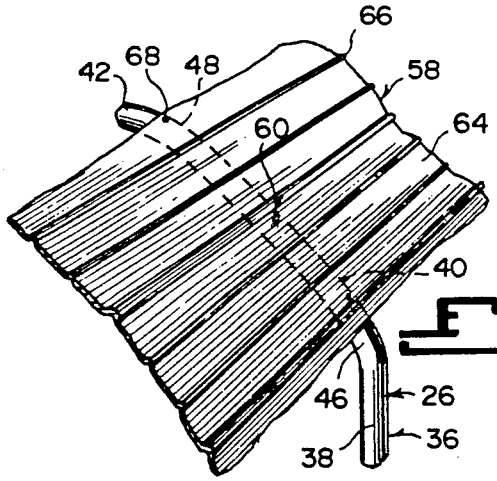
FIG. 4 is a enlarged perspective view as indicated by arrow 4 in FIG. 1.
Figure 5:
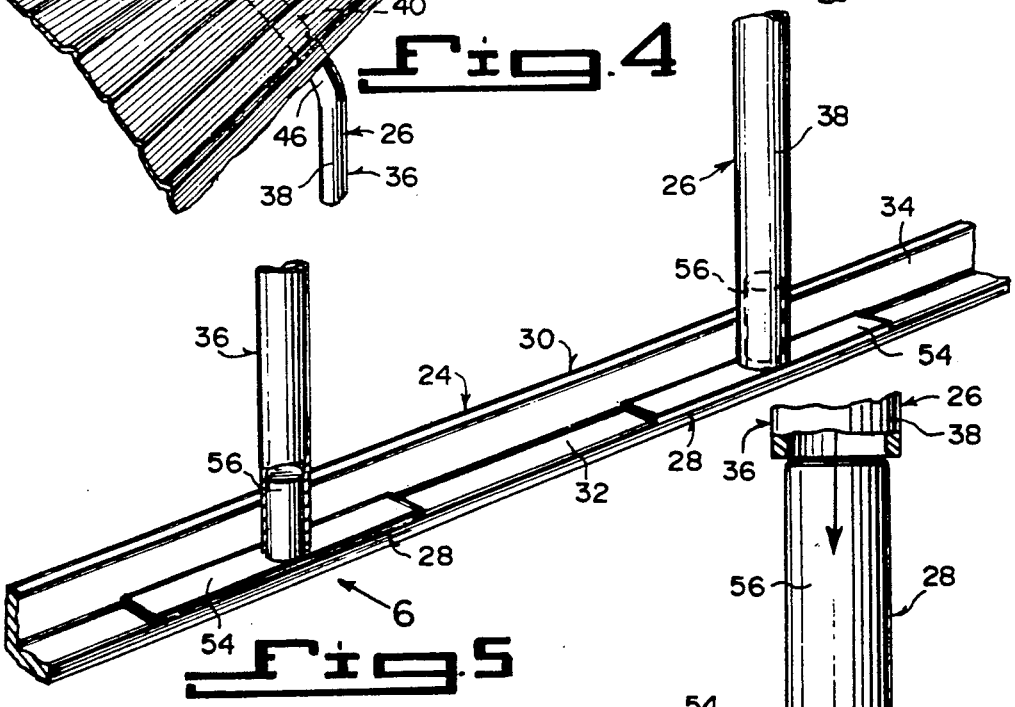
FIG. 5 is an enlarged perspective view as indicated by arrow 5 in FIG. 2.
Figure 6:
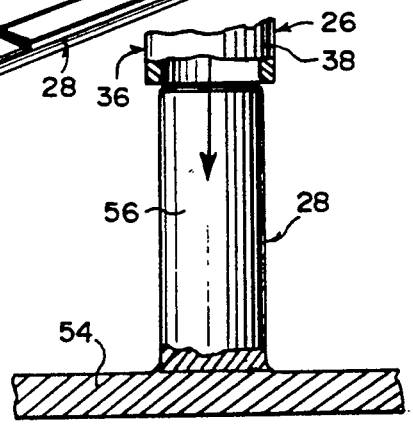
FIG. 6 is a further enlarged elevational view, taken in direction of arrow 6 in FIG. 5, with parts broken away and in section with the column segment of the arched rib ready to be inserted onto the short cylindrical post.

Turning now descriptively to the drawings, in which similar reference characters denote similar elements throughout the several views, the Figures illustrate a prefabricated shelter 10, which consists of an arched framework 12 having open opposite ends 14 and 16. A structure 18 is for securing the framework 12 to the ground 20. A roof assembly 22 is mounted to the top of the arched framework 12, so as to protect and cover anything positioned under the roof assembly 22.

The arched framework 12 includes a pair of side bottom rails 24, a plurality of arcuate ribs 26 and apparatus 28 for retaining the bottom portions of the arcuate ribs 26 to the side bottom rails 24. The arcuate ribs 26 are in spaced apart relationships to each other to form the arched framework 12 in a generally lightweight and strong configuration.

Each side bottom rail 24 is a elongated L-shaped angle member 30 having a first leg 32, which sits upon the ground 20 and a second leg 34, which extends upwardly next to the bottom portions of one side of the arcuate ribs 26.

Each arcuate rib 26 is of a unity construction and is fabricated out of an elongated hollow tubular member 36. Each arcuate rib 26 contains a pair of upright column segments 38, a pair of eaves corner segments 40 and a pair of rafter segments 42 terminating at a peak 44.

Each arcuate rib 26 further includes a pair of first bend segments 46, each located between a top of one column segment 38 and a bottom of one eaves corner segment 40. A pair of second bend segments 48 are provided, with each located between a top of one eaves corner segment 40 and a bottom of one rafter segment 42. A center bend segment 50 is located between the tops of the rafter segments 42, which is the peak 44.

The ground securing structure 18 is a plurality of anchors 52, extending downwardly from the first legs 32 of the elongated L-shaped angle members 30, wherein the anchors 52 are forced into the ground 20.

Each retaining apparatus 28 includes a rectangular plate 54 attached onto the first leg 32 of one of the L-shaped angle members 30. A short cylindrical post 56 is mounted onto and extends upwardly from the rectangular plate 54, so that the bottom end of one of the upright column segments 38 can fit thereon.

The roof assembly 22 contains a roof 58 to cover the rafter segments 42 and eaves corner segments 40 of the arcuate ribs 26. A plurality of fasteners 60 are for attaching the roof 58 to the rafter segments 42 and the eaves corner segments 40 of the arcuate ribs 26. The roof assembly 22 further contains a J-channel trim 62 to be attached to the edges of the roof 58 above the open opposite ends 14 and 16 of the arched framework 12, so that no sharp edges are exposed.

The roof 58 is fabricated out of corrugated sheathing 64, in which the corrugations 66 run lengthwise between the open opposite ends 14 and 16 of the arched framework 12 and transversely across the rafter segments 42 and the eaves corner segments 40 of the arcuate ribs 26 for added strength. Each fastener 60 is an enamelized screw 68 for low maintenance requirements.

Each side bottom rail 24 is typically, but not limited to, be fabricated out of three inch by two inch by one quarter inch steel. Each arcuate rib 26 is typically, but not limited to, be fabricated out of two and a half inch number eleven gauge galvanized steel. The corrugated sheathing 64 of the roof 58 is typically, but not limited to, be fabricated out of twenty nine gauge high grade steel.

The prefabricated shelter 10 can be made in multiple sizes, so that it can be used in different ways for protecting and covering various objects and people.

| LIST OF REFERENCE NUMBERS | |
|---|---|
| 10 | prefabricated shelter |
| 12 | arched framework |
| 14 | open end of 12 |
| 16 | open end of 12 |
| 18 | securing structure |
| 20 | ground |
| 22 | roof assembly |
| 24 | side bottom rail |
| 26 | arcuate rib |
| 28 | retaining apparatus |
| 30 | elongated L-shaped angle member for 24 |
| 32 | first leg of 30 |
| 34 | second leg of 30 |
| 36 | elongated hollow tubular member for 26 |
| 38 | column segment on 26 |
| 40 | eaves corner segment on 26 |
| 42 | rafter segment on 26 |
| 44 | peak on 26 |
| 46 | first bend segment between 38 and 40 |
| 48 | second bend segment between 40 and 42 |
| 50 | center bend segment at 44 |
| 52 | anchor for 18 |
| 54 | rectangular plate |
| 56 | short cylindrical post |
| 58 | roof |
| 60 | fastener |
| 62 | J-channel trim |
| 64 | corrugated sheathing for 58 |
| 66 | corrugation of 64 |
| 68 | enamelized screw |

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A prefabricated shelter which comprises:

a) an arched framework having open opposite ends and a plurality of arcuate ribs, said arched framework includes a pair of slide bottom rails, each said bottom rail is an elongated L-shaped angle member having a first leg which sits upon the ground and a second leg which extends upwardly next to the bottom portions of one side of said arcuate ribs, each said arcuate rib is of a unity construction and is fabricated out of an elongated hollow tubular member, each said arcuate rib includes a pair of upright column segments, a pair of eaves corner segments, and a pair of rafter segments terminating at a peak, each said arcuate rib includes a pair of first bend segments, each located between a top of one said column segment and a bottom of one said eaves corner segment, a pair of second bend segments, each located between a top of one said eaves corner segment and a bottom of one said rafter segment, and a center bend segment located between the tops of said rafter segments, which is the peak, and means for retaining the bottom portions of said arcuate ribs to said side bottom rails, in which said arcuate ribs will be in spaced apart relationships to each other to form said arched framework in a generally lightweight and strong configuration, each said retaining means includes a rectangular plate attached onto the first leg of one of the L-shaped angle members, and a short cylindrical post mounted onto and extending upwardly from said rectangular plate, the bottom end of one of said upright column segments fits thereon.

2. A prefabricated shelter as recited in claim 1, wherein said roof assembly includes:

a a roof to cover said a rafter segments and eaves corner segments of said arcuate ribs; and b) a plurality of fasteners attaching said roof to said rafter segments and said eaves corner segments of said arcuate ribs.

3. A prefabricated shelter as recited in claim 2, wherein said roof assembly further includes a J-channel trim attached to the edges of said roof above the open opposite ends of said arched framework, so that no sharp edges are exposed.

4. A prefabricated shelter as recited in claim 3, wherein said roof is fabricated out of corrugated sheathing in which the corrugations run lengthwise between the open opposite ends of said arched framework and transversely across said rafter segments and said eaves corner segments of said arcuate ribs for added strength.

5. A prefabricated shelter as recited in claim 4, wherein each said fastener is an enamelized screw for low maintenance requirements.

6. A prefabricated shelter as recited in claim 5, wherein each said side bottom rail is fabricated out of three inch by two inch by one quarter inch steel.

7. A prefabricate shelter as recited in claim 6, wherein each said arcuate rib is fabricated out of two and a half inch number eleven gauge galvanized steel.

8. A prefabricated shelter as recited in claim 7, wherein said corrugated sheating of said roof is fabricated out of twenty nine gauge high grade steel.

* * * * *